US008662064B1

(12) United States Patent
Campbell

(10) Patent No.: US 8,662,064 B1
(45) Date of Patent: Mar. 4, 2014

(54) APPARATUS AND METHOD FOR ARCHERY RECOIL STABILIZATION

(71) Applicant: Charles Campbell, Mohnton, PA (US)

(72) Inventor: Charles Campbell, Mohnton, PA (US)

( * ) Notice: Subject to any disclaimer, the term of this patent is extended or adjusted under 35 U.S.C. 154(b) by 0 days.

(21) Appl. No.: 13/773,186

(22) Filed: Feb. 21, 2013

(51) Int. Cl.
*F41B 5/20* (2006.01)
*F41A 23/00* (2006.01)
*F41B 5/14* (2006.01)

(52) U.S. Cl.
CPC ..... *F41B 5/1426* (2013.01); *F41A 23/00* (2013.01)
USPC ..... 124/89; 124/86; 124/88; 42/94

(58) Field of Classification Search
CPC ..... F41B 5/1426; F41A 23/00
USPC ..... 124/86, 88, 89; 42/94
See application file for complete search history.

(56) References Cited

U.S. PATENT DOCUMENTS 915,481 A * 3/1909 Roop ..... 42/94
1,103,824 A * 7/1914 Page ..... 42/94
3,167,062 A * 1/1965 Zwickey ..... 124/23.1
3,623,468 A * 11/1971 Crest ..... 124/24.1
3,670,712 A * 6/1972 Izuta ..... 124/89
3,693,973 A * 9/1972 Wattenburg ..... 473/463
3,834,368 A * 9/1974 Geiger ..... 124/20.3
3,923,035 A * 12/1975 Trotter ..... 124/25.6
4,048,674 A * 9/1977 Chesnick ..... 2/16
4,329,972 A * 5/1982 Wilson ..... 124/24.1
4,343,286 A * 8/1982 Thacker ..... 124/24.1
4,575,964 A * 3/1986 Griffin ..... 42/94
4,662,344 A * 5/1987 Mitchell ..... 124/22
4,714,071 A * 12/1987 Saunders ..... 124/88
4,787,361 A * 11/1988 Vyprachticky ..... 124/88
4,836,177 A * 6/1989 Williams ..... 124/89
4,976,250 A * 12/1990 Jeffrey ..... 124/25
5,103,798 A * 4/1992 McGraw et al. ..... 124/88
5,137,008 A * 8/1992 Taylor ..... 124/88
5,349,937 A * 9/1994 Burling ..... 124/25.6
5,351,867 A * 10/1994 Vest ..... 224/661
5,464,002 A * 11/1995 Lavoie et al. ..... 124/86
5,531,211 A * 7/1996 Wilfong, Jr. ..... 124/86
5,784,820 A * 7/1998 Wood ..... 42/94
5,853,000 A * 12/1998 Torgerson et al. ..... 124/88
5,884,616 A * 3/1999 Skaleski ..... 124/88
6,173,707 B1 * 1/2001 Howell et al. ..... 124/88
7,152,595 B1 * 12/2006 Muhich ..... 124/86
7,849,846 B1 * 12/2010 Boucher ..... 124/86
7,954,175 B2 * 6/2011 Platt ..... 2/161.5
8,225,778 B2 * 7/2012 Walk et al. ..... 124/89
D668,729 S * 10/2012 Greenhoe ..... D22/107
8,347,870 B1 * 1/2013 Mahutga ..... 124/89

(Continued)

*Primary Examiner* — Gene Kim
*Assistant Examiner* — Alexander Niconovich

(57) ABSTRACT

The invention disclosed is an apparatus and method for stabilizing an archery bow and reducing recoil during arrow draw and release. The apparatus comprises an adjustable arm clamp assembly; a rod; a support body for attaching the arm clamp assembly to the rod; and a mounting block for attaching the rod to an archery bow. The archery recoil stabilizer is lightweight, adjustable and relies on bracing the arm from the forearm position to restrict translational and rotational movement of the bow as well as minimize recoil impacts. It supports the arm by bracing the forearm relative to the bow, and reduces or eliminates bow hand torque, providing improved stabilization during both arrow draw and release. Additionally, this invention reduces the stress and recoil on the arm of the archer that can cause pain or injury, or can compromise the flight of the arrow and the accuracy of the shot.

11 Claims, 8 Drawing Sheets

(56) References Cited

U.S. PATENT DOCUMENTS

| | | | | |
|---|---|---|---|---|
| 8,360,044 | B2 * | 1/2013 | Platt | 124/88 |
| 2005/0072414 | A1 * | 4/2005 | Bryant | 124/24.1 |
| 2008/0183116 | A1 * | 7/2008 | Platt | 602/21 |
| 2010/0108048 | A1 | 5/2010 | Mancini | |
| 2010/0326415 | A1 | 12/2010 | Walk et al. | |
| 2011/0203563 | A1 * | 8/2011 | Platt | 124/88 |
| 2012/0174904 | A1 * | 7/2012 | Greenhoe | 124/89 |

* cited by examiner

APPARATUS AND METHOD FOR ARCHERY RECOIL STABILIZATION

CROSS-REFERENCE TO RELATED APPLICATIONS

Not applicable.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND OF THE INVENTION

The present invention relates generally to the field of archery. More specifically, it relates to an apparatus and method for stabilizing a bow during arrow draw and release.

Bowstring draw and release during an archery shot generate torque and recoil to the bow that can impact the archer and the shot significantly. The operations of draw, then release from the drawn position transfer force from the archer to the string, then to the arrow to propel it at high velocity toward its target. The pull of the string in the archer's hand, or draw, generates pressure that can cause the bow to shift up or down as well as cant from side to side. The bow twists slightly upon release in the archer's hand, swinging the string in toward the supporting arm. Also, the bow can tilt forward or backward during draw, which can generate added percussive force. The release of force as the arrow leaves contact with the bow, as well as the vibration from the bowstring, significantly affect the archer's supporting arm, causing pain, muscle strain or other physical consequences.

In addition to the stress on the arm of the archer, the consequences of archery draw and release described above can be problematic in that they can disturb the intended trajectory of the arrow. The torque, recoil vibration and swing as the arrow is released can result in dip, swivel or other motion of the bow that will compromise the accuracy of the shot.

Archery accessories generally address either protection of the arm from the string recoil or reducing vibration of the bow itself, but not both. Commercially available stabilizing devices are generally heavy. Currently, devices for reducing the impacts of draw and recoil upon an archer include armguards, forearm protectors, handgrips, wrist braces and shock absorbers. Some devices are designed specifically to dampen vibrational energy, such as U.S. Pat. No. 8,225,778B2, US Patent 20100326415A1 and U.S. Pat. No. 3,670,712A. Other inventions involve modifying the bow itself to absorb shock and reduce vibration, including US Patent 20100108048A1. Also, stabilizers have been disclosed that address weight distribution imbalance, including U.S. Pat. No. 8,347,870B1, where the tendency of the bow to tilt or swing is restricted by bow weight distribution adjustments.

The invention disclosed herein overcomes limitations of commercially available products by providing a new apparatus and method for both protection of the archer from impacts to the arm and stabilization of the bow for improving accuracy of the shot. Distinct from presently available products, this invention is mounted onto the archer's own bow, is relatively light weight, and relies on bracing the arm from the forearm position to restrict translational and rotational movement of the bow and diminish recoil impacts. The adjustable attachment of the apparatus at both the archer's arm and the bow allow for use by archers of a wide size range and shooting ability. This invention eliminates the need for slings, and prevents the bow from jumping from the hand.

All patents, patent applications, provisional patent applications and publications referred to or cited herein, are incorporated by reference in their entirety to the extent they are not inconsistent with the teachings of the specification.

BRIEF DESCRIPTION OF THE INVENTION

The invention described herein is an apparatus as well as a method for stabilizing an archery bow within an archer's hand and reducing archery recoil impacts. The archery recoil stabilizer provides stabilization of the bow by bracing the archer's forearm parallel to the shot and perpendicular to the bowstring. Bracing the arm restricts bow movement and allows the hand to grip the bow more effectively, which results in stability over the course of a shot, minimizes potentially painful recoil and diminishes unintended deviations from the intended arrow flight.

Bracing the arm within the archery recoil stabilizer improves efficacy of the archer's draw and release by stabilizing the bow in the archer's hand. It connects the arm and bow and joins them at the correct, comfortable and preset distance from each other. This results in the reduction in swing or dip in the bow upon string release, improving shot accuracy. The efficiency of the archer is further increased because anchoring the arm relative to the bow removes a portion of the string vibration generated by the force of the string upon release.

In addition to diminishing unwanted movement and vibration, the archery recoil stabilizer protects the archer from some of the bow recoil vibration which can cause pain or harm his or her hand, arm and shoulder. When properly adjusted, the offset rod assures that the bowstring is maintained safely and at the proper angle away from the archer's arm.

The archery recoil stabilizer is deliberately lightweight and adjustable to accommodate use by archers of all sizes and body types. Adjustability can be effected from either side of the apparatus at both the attachment to the bow, by movably securing the mounting block, and at the attachment to the archers arm, by moveably securing the support body and/or the arm clamp to further accommodate archers of different sizes and both left and right handed archers.

DESCRIPTION OF THE FIGURES OF THE DRAWINGS

The present invention is best understood in conjunction with the accompanying drawings, descriptions and reference numbers.

DESCRIPTION OF REFERENCE NUMBERS AND LETTERS

Figure 1A:
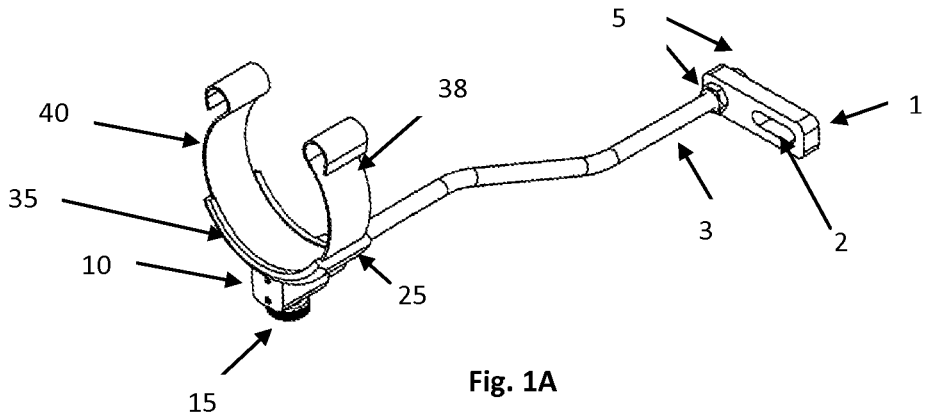
FIG. 1A shows a perspective view of the invention from the front.

1. Mounting block
2. Bow receiving aperture
3. Rod
4. Rod receiving port
5. Jam nut
6. Rod receiving aperture
10. Support body
15. Knurled knob
18. Knurled knob receiving port
20. Set screw
25. Clamp track
30. Track bed
35. Track lip
38. Arm band
40. Arm clamp assembly
43. Binding post
44. Binding post entry port
45. Clamp barrel

DETAILED DESCRIPTION OF THE INVENTION

The invention disclosed is an apparatus for archery bow stabilization comprising an adjustable arm clamp assembly; a rod that may include an offset bend to position an archer's arm parallel to the trajectory of an arrow while removing it from a path of a vibrating string; a support body for attaching the arm clamp assembly to the rod; and a mounting block for attaching the rod to an archery bow. It provides support for, and bracing of, the archer's arm to diminish adverse impacts to the archer and improve shot accuracy.

The invention is explained herein with references to the attached drawings.

Figure 1B:
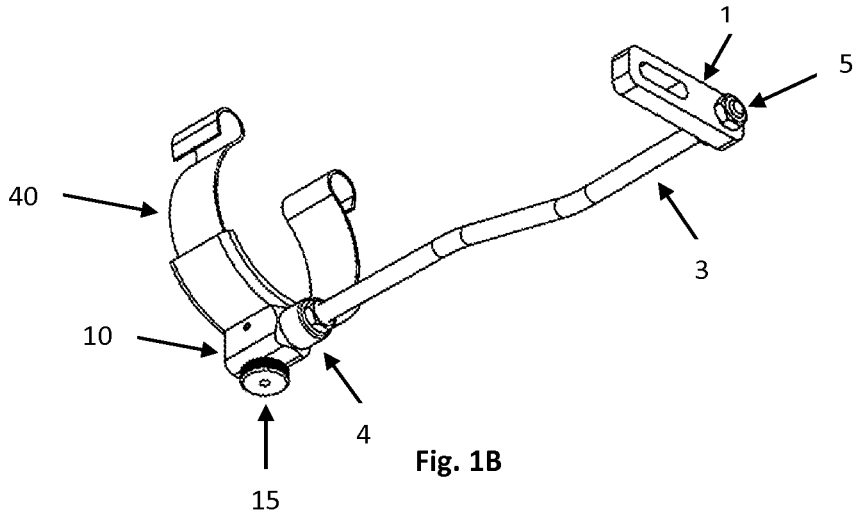
FIG. 1B show a perspective view of the invention from the back.

FIGS. 1A and 1B show two separate perspective views of the invention. At one end, the mounting block 1 is adjustably attached to the end of the rod 3. In this embodiment, the mounting block 1 is secured to the rod 3 by a pair of opposing bolts or jam nuts 5 threaded onto the end of the rod 3. By loosening, adjusting, then tightening the jam nuts 5, the mounting block 1 can be adjusted and securely repositioned to accommodate the dimensions of the archer's arm. The rod 5 is further adjustably attached at the opposite end to the support body 10. The support body 10 attaches to the rod 3 by placing the rod 3 into the rod receiving port 4, and adjustably turning to tighten or loosen the rod relative to the knurled knob 15. The support body 10 also attaches the arm clamp assembly 40 to the apparatus, and provides a separate adjustment for lateral movement or pivot of the arm clamp relative to the support body.

Figure 1C:
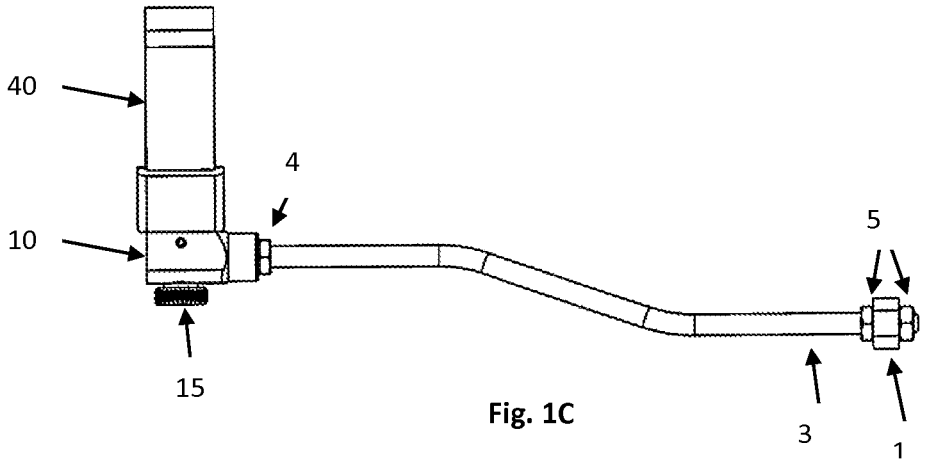
FIG. 1C is a side view of the invention.

FIG. 1C is a side view of the invention. It illustrates the mounting block 1 adjustably attached to one end of the rod 3 by jam nuts 5. In this embodiment, opposable nuts are used on the threaded rod 3 as a means of freezing the position of the mounting block 1 relative to the rest of the apparatus. However, it is possible to adjustably secure the rod 3 to the mounting block 1 by other means, such as a split ring with set screws, or a locking cam. The opposite end of the rod 3 is adjustably attached to the support body 10, which also connects the arm clamp assembly 40 to the apparatus.

Figure 2A:
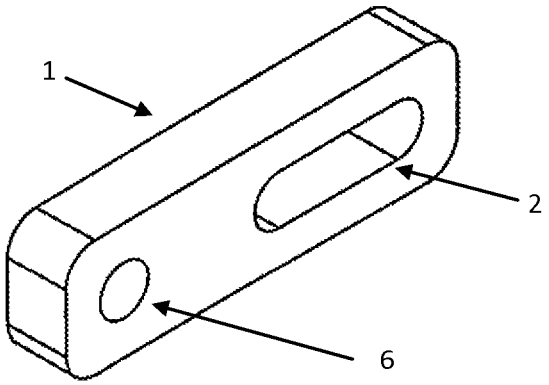
FIG. 2A is a perspective view of the mounting block.

FIG. 2A is a perspective view of the mounting block 1. In this embodiment, the mounting block 1 is rectangular and the edges are rounded for ease in adjusting its location; other geometric configurations can be envisioned for the mounting block 1 without compromising functionality. The pictured embodiment comprises a round rod receiving aperture and elongated or oblong bow receiving aperture for adjustable attachment to the archer's bow.

Figure 2B:
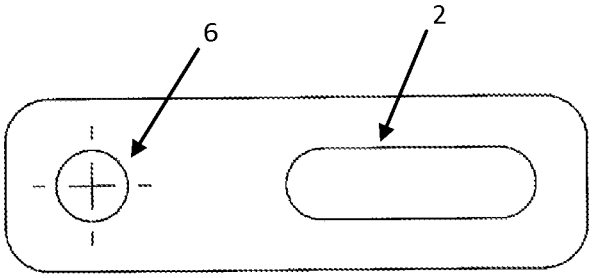
FIG. 2B is a front view of the mounting block.
Figure 2C:
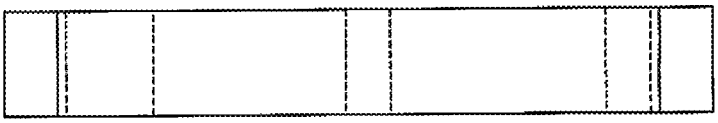
FIG. 2C is a side view of the mounting block.

FIG. 2B is a front view of the mounting block 1. The rod 3 passes through the rod receiving aperture in the mounting block 1, and is secured in this embodiment by manually tightening the jam nuts 5 on either side of the mounting block 1. FIG. 2B shows the rod receiving aperture marked. A second aperture, which may be elongated or oblong, adjustably receives and attaches a connector or stabilizer bushing from the archer's bow, thereby mounting the invention onto the bow. By moving the connector or stabilizer bushing on the archer's bow within the elongated or oblong bow receiving aperture 2, the apparatus' position relative to the bow can be adjusted to accommodate different body shapes and sizes of the archer. FIG. 2C is a side view of the mounting block 1.

Figure 3:
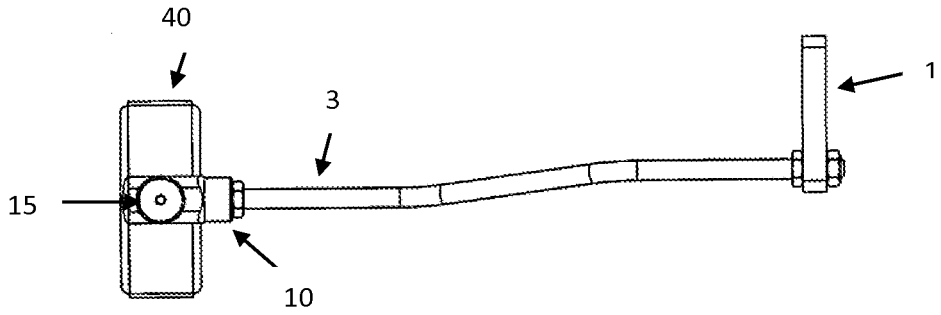
FIG. 3 is a view of the invention illustrating the support body from the bottom.

FIG. 3 shows the invention with the arm clamp assembly 40 attached to the rod 3, and also shows the attached support body 10 and knurled knob 15. The knurled knob 15 is turned to open or close the arm band 38 within the arm clamp assembly 40 about the forearm of the archer.

Figure 4A:
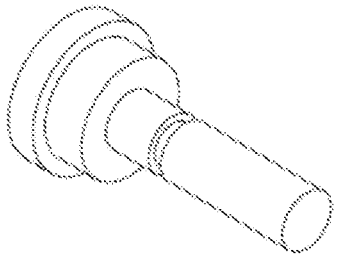
FIG. 4A is a perspective view of the knurled knob.
Figure 4B:
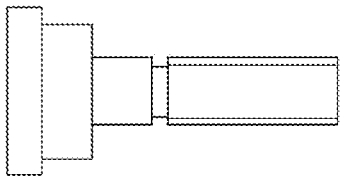
FIG. 4B is a side view of the knurled knob.
Figure 4C:
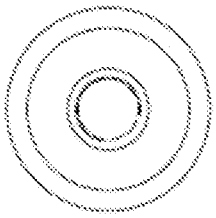
FIG. 4C is a top view of the knurled knob.

In FIGS. 4A through 4C, views of the knurled knob 15 are illustrated. The knurled knob 15 is threaded within the support body 10. In FIG. 4A, a perspective view of the knurled knob 15 is illustrated. FIGS. 4B and 4C show the knob 15 from the side and front view respectively. In one embodiment, this knob 15 may be textured around the grasping portion to provide friction between the fingers of the archer and the knob 15, rendering it easier to turn and thereby adjust the arms of the arm clamp 40.

Figure 5A:
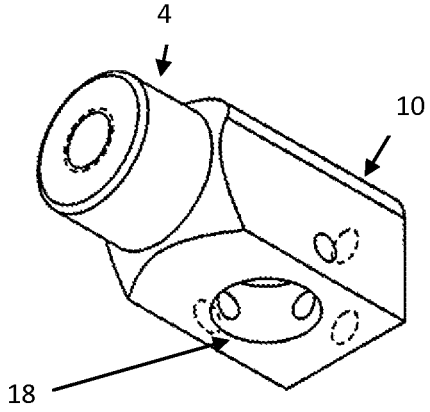
FIG. 5A is a perspective view of the support body.
Figure 5B:
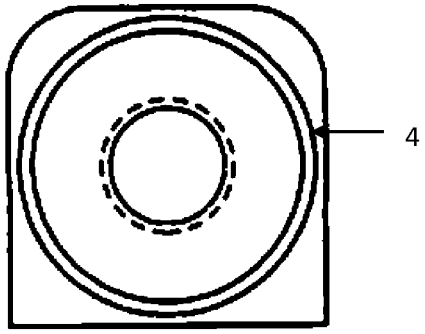
FIG. 5B is a front detail of the rod receiving port.

FIG. 5A is a perspective view of the support body 10 with a detail of the rod receiving port 4 illustrated in FIG. 5B. The rod 3 enters the rod receiving port 4 and is maintained there by the sides of the rod receiving port 4, and is fastened therein by a plurality of set screws 20. The set screws 20 are loosened to adjust the rod 5 relative to the support body 10, in order to lengthen or decrease the distance between the arm clamp assembly 40 and the archer's hand. This also allows lateral adjustment of the arm clamp relative to the position of the archer's hand. Once the adjustments are made, the set screws 20 are tightened to secure the rod 3.

Figure 5C:
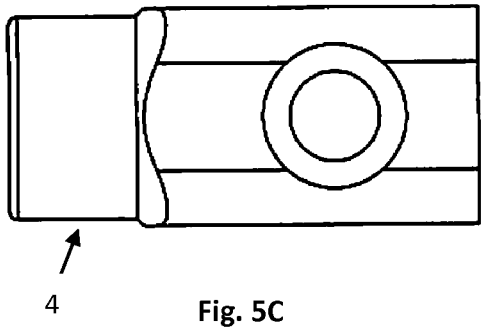
FIG. 5C shows one side of the support body.

In FIG. 5C, a side view of the support body 10 is presented. This figure shows the side that contacts the arm clamp 40. This side is contoured to allow for pivot of the arm clamp assembly 40 relative to the apparatus. A set screw port for locking the clamp barrel 45 in place underneath the clamp track 25 is shown.

Figure 5D:
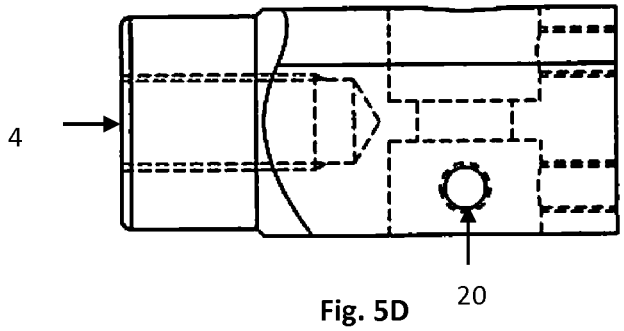
FIG. 5D shows a second and fourth side of the support body (this view is a mirror image of the opposite side).
Figure 5E:
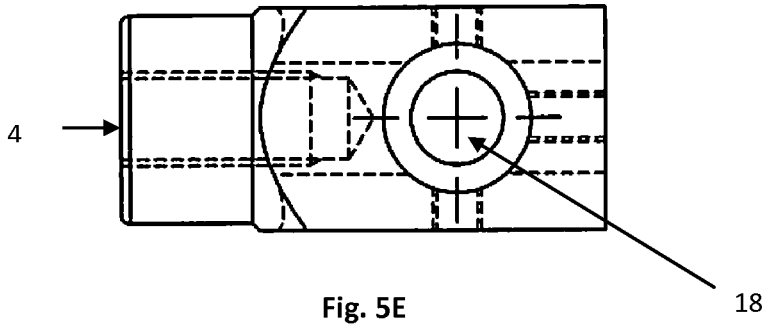
FIG. 5E shows a third side of the support body.
Figure 5F:
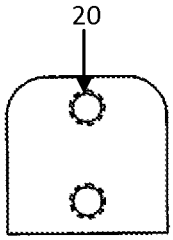
FIG. 5F shows the bottom of the support body.

As shown in the illustration in FIG. 5D, a set screw 20 is incorporated to adjustably freeze the rod 3 and arm clamp assembly 40 within the support body 10. The opposite side is a mirror image of the view in this figure, with another set screw 20 provided for opposite-handed archers; it may be capped or empty when the opposite set screw 20 is utilized. As in FIG. 5A, this set screw 20 locks the barrel of the clamp track 25 in place. This view also indicates where the rod 3 enters through the rod receiving port 4. On the remaining side, shown in FIG. 5E, a recessed counter bore for the knurled knob 15 is illustrated. This counter bore effectuates adjustably securing of the knurled knob 15 within the clamp barrel 45 of the clamp track 25. The bottom of the support body 10, which is shown in FIG. 5F, is common and perpendicular to all sides. The neck of the support body 10, or rod receiving port 4, narrows from the body itself; this allows for adjustability and support of the rod 3.

Figure 6A:
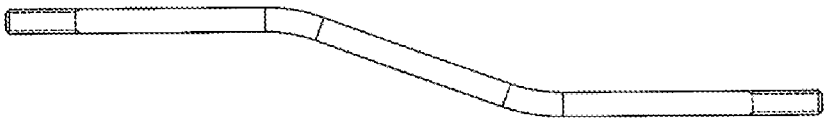
FIG. 6A is a perspective view of the rod.
Figure 6B:
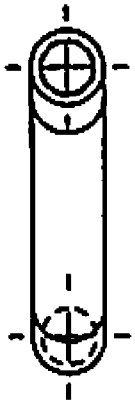
FIG. 6B is a cross section of the rod.

FIG. 6A is a view of the rod 3. The rod 3 may vary in length for use by differently sized individuals (such as women, children, etc.). The rod 3, which may be threaded at each end, is offset by an angular displacement midway in its length so as to align the bow appropriately relative to the forearm of the archer. The offset bend positions an archer's arm parallel to the trajectory of an arrow while removing it from a path of a vibrating string, which allows for clearance of the string and a natural and comfortable angle of the archer's arm. In the presented embodiment, one end of the rod 3 threads into the rod receiving aperture 6 in the mounting block 1 and is locked into the appropriate rotational position by a set of jam nuts 5. The opposite end enters the rod receiving port 4 on the support body 10 and is adjustably fastened thereby with a set screw 20. A cross-section of the rod 3 is illustrated in FIG. 6B.

Figure 7A:
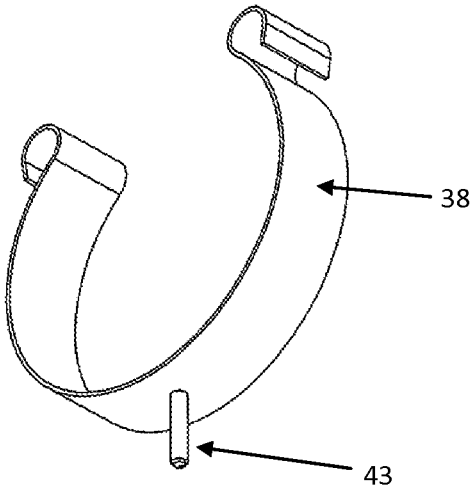
FIG. 7A is a perspective view of the flexible arm band component of the arm clamp assembly and binding post.

FIG. 7A is a perspective view of the arm clamp assembly 40. The arm band 38 is shaped in a semi-circular form so as to fit conformingly to the archer's forearm. It is comprised of a material of sufficient flexibility to allow bend, or movement of the ends of the arm clamp relative to each other, but enough rigidity to support and brace the forearm within it. In the preferred embodiment, a flexible metal of sufficient strength and rebounding properties to support the arm against torque and firmly attach to the remaining assembly is used. The arm band 38 may optionally be rubber coated for improved contact with the archer's arm and the track bed 30, affording slip resistance and improved comfort and grip of the forearm by the arm clamp assembly. A stem, or binding post 43, is positioned exactly halfway between the opposite ends of the arms of the arm band 38. By engaging the binding post 43 within the clamp barrel 45 in the threaded portion of the support body 10, it draws the opposing arms of the arm band 38 together by pulling the bottom of the arm band 38 down along the clamp track 25, directing the opposite ends of the arm band 38 inward to enclose the archer's arm. Alternatively, to loosen the arm clamp assembly 40 on the arm of the archer, the knurled knob 15 is turned in the opposite direction, allowing the binding post 43 and therefore the base of the arm band 38 to rise in the clamp track 25. As it rises, the opposing ends of the arm band 38 spread apart to allow the archer to position his or her arm comfortably inside the arm clamp assembly 40 and secure it. The track lip 35 maintains the arm band 38 within the clamp track 25, but the opposing ends flex and draw together as they rise or fall within the track itself.

Figure 7B:
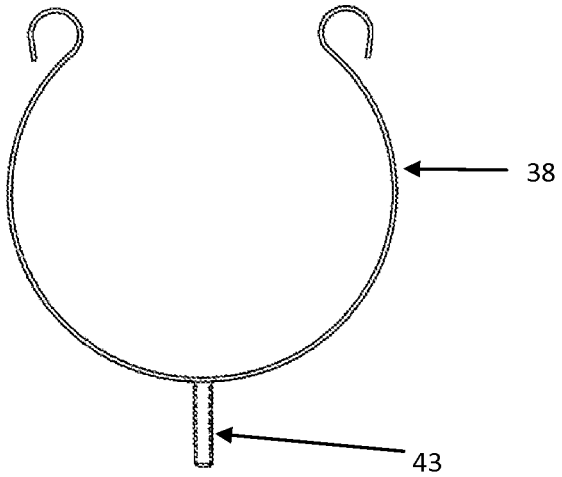
FIG. 7B is a side view of the arm band component of the arm clamp assembly and binding post.
Figure 7C:
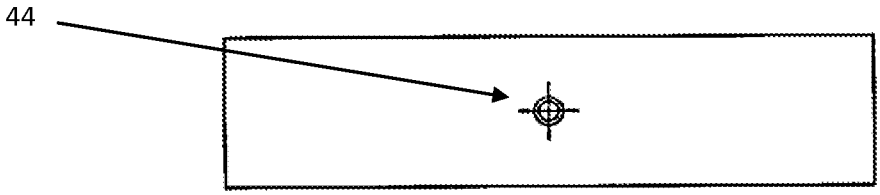
FIG. 7C shows the bottom segment of the arm band component of the arm clamp assembly 40 from below.

In FIG. 7B, a view of the arm band 38 of the arm clamp assembly 40 is depicted. The binding post 43 passes through an entry port in the track bed 30, and into the hollow clamp barrel 45. As the binding post 43 within the barrel is drawn down by adjustment of the knurled knob 15, the opposing ends of the arm band 38, directed within the clamp track 25, can be drawn together or apart, changing the radius to brace or release the archer's forearm. Engaging the archer's forearm within the arm clamp assembly 40 aligned with the apparatus appropriately positioned substantially prevents rearward tipping of the bow as well as pivoting of the bow handle about its vertical axis. In one embodiment, the clamp barrel 45 is grooved to prevent binding upon pivot. FIG. 7C shows the bottom segment of the arm clamp 40 from below, and illustrates the entry point of the binding post 43. In an alternative embodiment, the binding post 43 and arms are cast together.

Figure 8A:
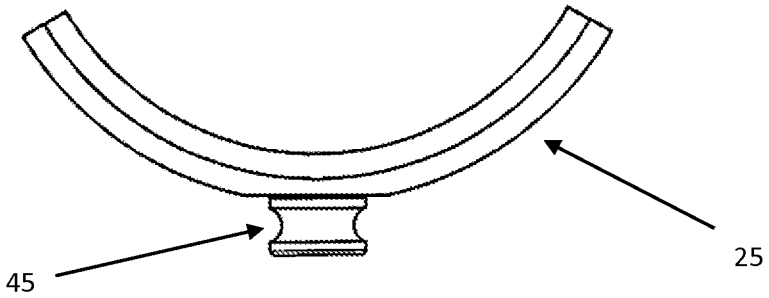
FIG. 8A is a side view of the clamp track and barrel.
Figure 8B:
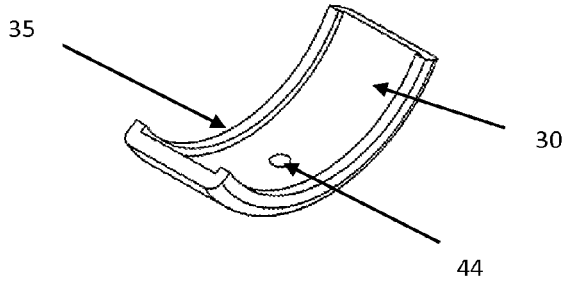
FIG. 8B is a perspective view of the clamp track.

FIG. 8A shows the side view of the clamp track 25 and clamp barrel 45. The curved track, made of a non-flexible material, holds the more flexible arm band 38 in place but allows for movement of the arm band up and down within the clamp track 25. The clamp barrel 45 houses the binding post 43 and provides rigid support for the arm clamp assembly 40 upon the support body 10. FIG. 8B shows a perspective of the clamp track 25 from above. The raised lip on the clamp track keeps the arm band 38 secured within the clamp track and relative to the apparatus.

Figure 8C:
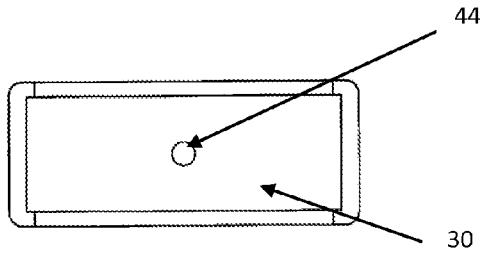
FIG. 8C is a view of the clamp track from below.
Figure 8D:
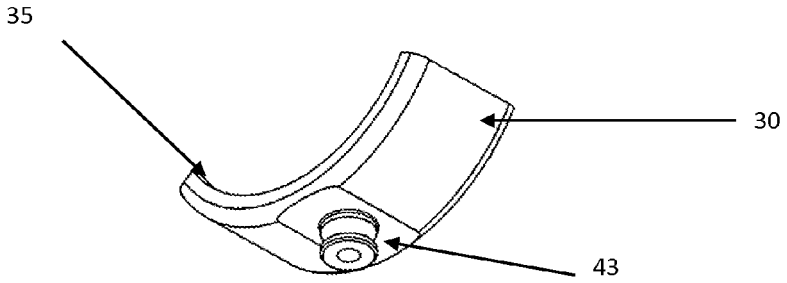
FIG. 8D is a perspective view of the clamp track from below showing the clamp barrel.
Figure 8E:
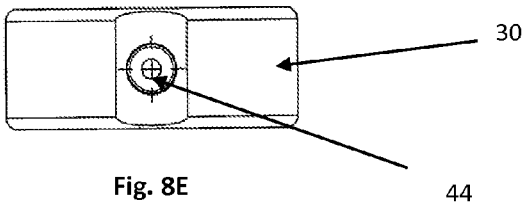
FIG. 8E illustrates the arm clamp from below showing the point of connection for the support body.

FIGS. 8C, 8D and 8E show the clamp track 25 from below. FIG. 8C illustrates the entry point for the binding post 43. FIG. 8D is a perspective view, showing the clamp barrel 45. In FIG. 8E, the point of connection for the support body 10 is presented. The opposing long edges of the arm band 38 are moveably retained by the track lip 35 within the clamp track 25.

The method of use for this invention comprises first adjustably loosening the arm band 38 of the arm clamp assembly 40 of the apparatus by turning the knurled knob 15 counterclockwise. The apparatus is then mounted on a bow with a connector or stabilizer bushing, generally on the bow riser. The bow, with the apparatus mounted upon it, is placed in the archer's bow hand, so the archer is positioned with the forearm within the arm band 38 of the apparatus with the archer's arm extended and the archer's hand on the grip of the bow. The mounting block and arm band are then positioned such that the support body 10 rests below the archer's forearm. The connector or stabilizer bushing of the bow is tightened, thereby securing the mounting block 1 to the bow. The rod 3 can be adjustably turned and tightened by opposably turning the jam nuts 5 and set screws 20, which secures the rod 3 in place. The knurled knob 15 is then turned clockwise to adjustably enclose the archer's forearm within the arm clamp assembly 40, allowing for bracing of the forearm of the archer against and within the apparatus once it has been positioned optimally relative to the hand and bow prior to the archer's shot.

It is understood that the foregoing examples are merely illustrative of the present invention. Certain modifications of the articles and/or methods employed may be made and still achieve the objectives of the invention. Such modifications are contemplated as within the scope of the claimed invention.

What is claimed is:

1. An apparatus for an archery bow for protection of the archer from impacts to the arm and stabilization of the bow for improving accuracy of the shot comprising:

an adjustable arm clamp assembly comprising a U-shaped elastically moveable band of flexible, sturdy material with opposing ends which can be widened or narrowed to conform to, provide contact with, and surround a majority of a user's arm without entirely encircling it, thereby restricting movement of the bow relative to the arm in all directions and allowing the user to easily insert or remove the arm without the use of straps or buckles;

a binding post positioned halfway between said ends and within a clamp barrel;

a clamp track positioned underneath and surrounding a periphery of said arm band and mounted on top of said clamp barrel;

a knurled knob threadably attached to said binding post through said clamp barrel that engages the binding post to move the band upward or downward upon turning said knob, thereby changing the circumference of the band so that it conforms to the user's arm;

a rod;

a means for attaching said arm clamp assembly to said rod; and a means for attaching said rod to an archery bow.

2. The apparatus of claim 1 wherein said rod is threaded on at least one end.

3. The apparatus of claim 2 wherein said rod includes an offset bend, whereby said offset bend positions an archer's arm parallel to the trajectory of an arrow while removing it from a path of a vibrating string.

4. The apparatus of claim 1 wherein said means for attaching said arm clamp assembly to said rod comprises a support body; said support body comprising a rod receiving port, a threaded knurled knob port, a binding post port, and set screws; said set screws integrating a knurled knob, said binding post and said rod receiving port.

5. The apparatus of claim 1 wherein said arm band is coated with rubber to afford slip resistance and improved comfort and grip of the user's arm by the arm clamp assembly.

6. The apparatus of claim 1 wherein said means for attaching said rod to a bow comprises a mounting block.

7. The apparatus of claim 6 where said mounting block comprises a rod receiving aperture and a bow receiving aperture, said mounting block is adjustable along said rod and locked in position on said rod with opposing jam nuts.

8. The apparatus of claim 7 where said mounting block is adjustable along said rod and is capable of being locked in position on a bow.

9. The apparatus of claim 6 where said mounting block is adjustable along said rod and is capable of being locked in position on a bow.

10. The apparatus of claim 1 wherein said flexible, sturdy material comprises a flexible metal or a material with substantially similar properties to a flexible metal to impart sufficient flexibility to allow bend, or movement of the ends of said arm clamp relative to each other but enough rigidity to support and brace the user's arm within it.

11. An apparatus for an archery bow comprising an adjustable arm clamp assembly, the adjustable arm clamp assembly comprising:

a semi-circular elastically moveable band of flexible, sturdy material with opposing ends which can be widened or narrowed to conform to, provide contact with, and surround a majority of a user's arm without entirely encircling it, thereby restricting movement of the bow relative to the arm in all directions and allowing the user to easily insert or remove the arm without the use of straps or buckles;

a binding post positioned halfway between said ends and within a clamp barrel, said binding post attached to said band and capable of moving said band;

a clamp track positioned underneath and surrounding a periphery of said arm band and mounted on top of said clamp barrel;

a knurled knob threadably attached to said binding post through said clamp barrel that engages the binding post to move said band upward or downward upon turning said knob, thereby changing the circumference of the band so that it conforms to the user's arm so that the band surrounds a majority of the user's arm without entirely encircling it;

a rod;

a means for attaching said arm clamp assembly to said rod, the means for attaching said arm clamp assembly to said rod comprising:

a support body, said support body comprising:

a rod receiving port, a threaded knurled knob port, a binding post port, and set screws, said set screws integrating said threaded knob, said binding post and said rod receiving port; and a means for attaching said rod to said archery bow, the means for attaching the rod to said bow comprising:

a mounting block, the mounting block comprising a rod receiving aperture and a bow receiving aperture, wherein the mounting block is adjustable along the rod and is locked in position on the rod with opposing jam nuts.

* * * * *